US005482505A

United States Patent [19]

Hedlund

[11] Patent Number: 5,482,505

[45] Date of Patent: Jan. 9, 1996

[54] ARRANGEMENT FOR EXTRACTION OF HARMFUL GASES FROM WORKPLACES

[75] Inventor: Per N. Hedlund, Helsingborg, Sweden

[73] Assignee: AB Ph. Nederman & Co., Helsingborg, Sweden

[21] Appl. No.: 270,462

[22] Filed: Jul. 5, 1994

[30] Foreign Application Priority Data

Jul. 12, 1993 [SE] Sweden ..... 9302403

[51] Int. Cl.[6] ..... B08B 15/04

[52] U.S. Cl. ..... 454/65; 285/165; 285/302

[58] Field of Search ..... 454/63, 65; 285/165, 285/302

[56] References Cited

U.S. PATENT DOCUMENTS

| | | | |
|---|---|---|---|
| 3,605,563 | 9/1971 | Parrett | 285/302 X |
| 3,818,817 | 6/1974 | Nederman | 454/65 |
| 4,158,462 | 6/1979 | Coral | 454/63 |
| 4,699,046 | 10/1987 | Bellieni | 454/65 |
| 4,860,644 | 8/1989 | Kohl et al. . | |

FOREIGN PATENT DOCUMENTS

| | | | |
|---|---|---|---|
| 2221919 | 11/1994 | France . | |
| 3132361 | 7/1983 | Germany . | |
| 4133757 | 4/1992 | Germany . | |
| 442835 | 2/1986 | Sweden . | |
| 600439 | 4/1948 | United Kingdom . | |
| 1506886 | 4/1978 | United Kingdom | 454/65 |
| 85/00764 | 2/1985 | WIPO . | |
| 90/07991 | 7/1990 | WIPO . | |
| 93/04719 | 3/1993 | WIPO . | |

*Primary Examiner*—Harold Joyce
*Attorney, Agent, or Firm*—Tarolli, Sundheim & Covell

[57] ABSTRACT

An arrangement for the extraction of harmful gases from workplaces, the arrangement (1) exhibiting a carrier arm system (9) having at least two arms (19, 20, 21) connected telescopically with each other so that the carrier arm system (9) can be given different lengths, whereby the carrier arm system (9) is swivelable around a horizontal spindle (17) so that it can be swivelled in a vertical direction and placed in different positions between a downward-directed, preferably substantially vertical end position and an outward-directed preferably substantially horizontal end position. In order to permit the necessary balancing of both the swivelling and positioning of the carrier arm system (9) and the telescoping function of the arms of the carrier arm system (9) when the carrier arm system (9) is swivelled within a large sector, at least one first device (22) is arranged to generate balancing forces in order to facilitate swivelling of the carrier arm system (9) in the vertical direction between the end positions and/or to facilitate the retention of the carder arm system (9) in set positions between the end positions, and at least one second device (28) is arranged to generate balancing forces which allow the arms ( 19, 20, 21) of the carrier arm system (9) to remain in the positions relative to each other that they were given by the telescopic function, at least when the carrier arm system (9) is directed substantially downwards.

15 Claims, 7 Drawing Sheets

ARRANGEMENT FOR EXTRACTION OF HARMFUL GASES FROM WORKPLACES

The present invention relates to an arrangement for the extraction of harmful gases from workplaces, the said arrangement exhibiting a carrier arm system having at least two arms connected telescopically with each other so that the carrier arm system can be given different lengths, whereby the carrier arm system exhibits a gas intake which is connected via a flexible hose to an extraction system that is intended to conduct away harmful gases that are drawn in via the gas intake and the hose, whereby the hose has variable length to permit its length to change when the length of the carrier arm system changes, and whereby the carrier arm system is swivelable around a horizontal spindle so that it can be swivelled in a vertical direction and placed in different positions between a downward-directed, preferably substantially vertical end position and an outward-directed preferably substantially horizontal end position.

Arrangements of the type mentioned by way of introduction are shown in GB-A-1 506 886. A substantial disadvantage of these known arrangements is that they are not automatically balanced to a sufficient degree if they are swivelable within large swivel ranges, for example within a sector between the vertical and horizontal planes.

The purpose of the present invention has been to eliminate this disadvantage, and this is achieved by the arrangement mentioned at the outset having been given the characteristics set out in claim 1 below.

With the aid of the said characteristics, balancing of both the swivelling function and the telescoping function are balances within the setting range of the arrangement even if it can be placed in a substantially vertical position and in a substantially horizontal position, and in all positions between.

The invention will be explained below with reference to the attached drawings, on which FIG. 1 illustrates with a side view an arrangement according to the invention;

Figure 1:
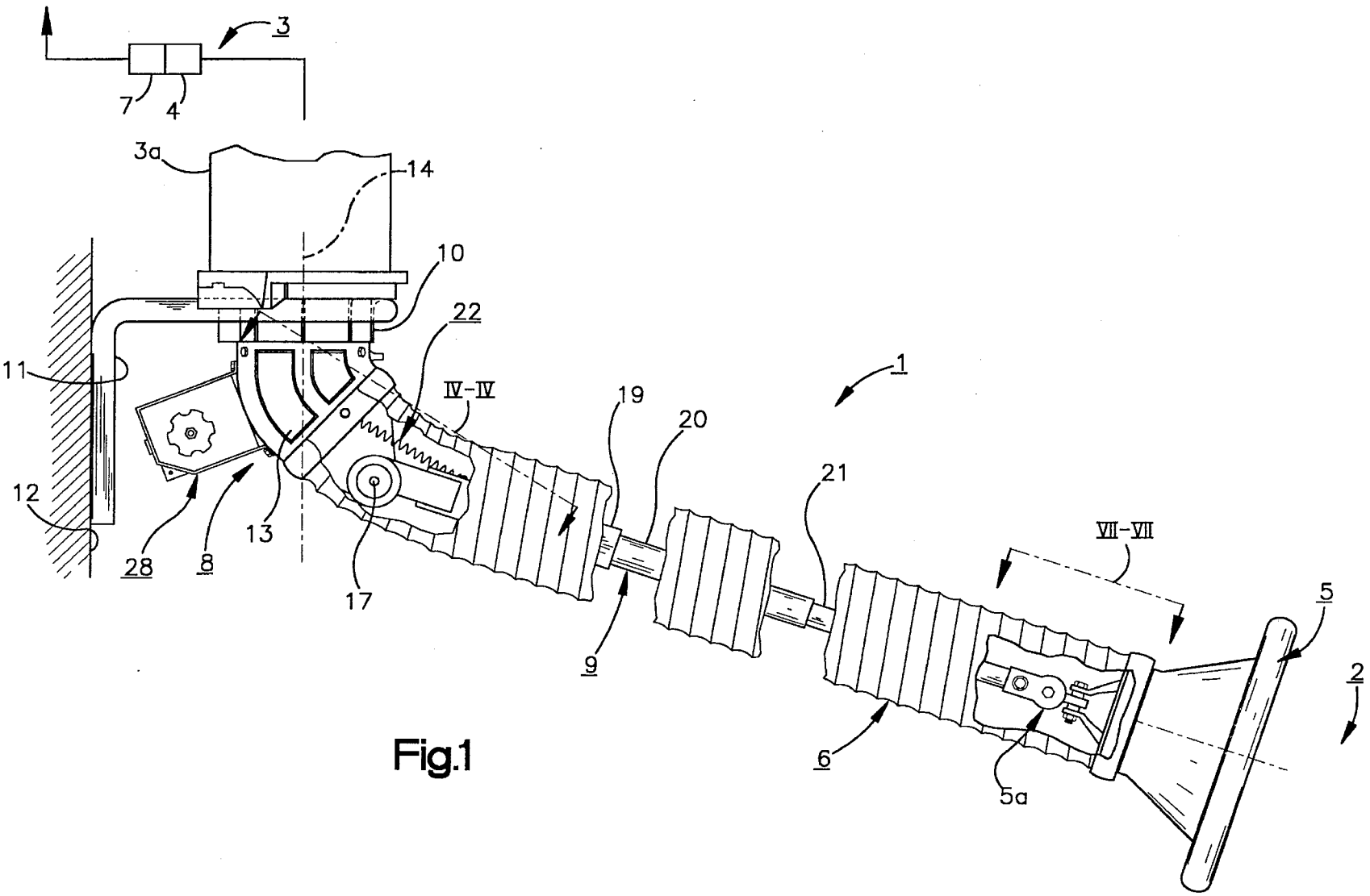
Figure 3:
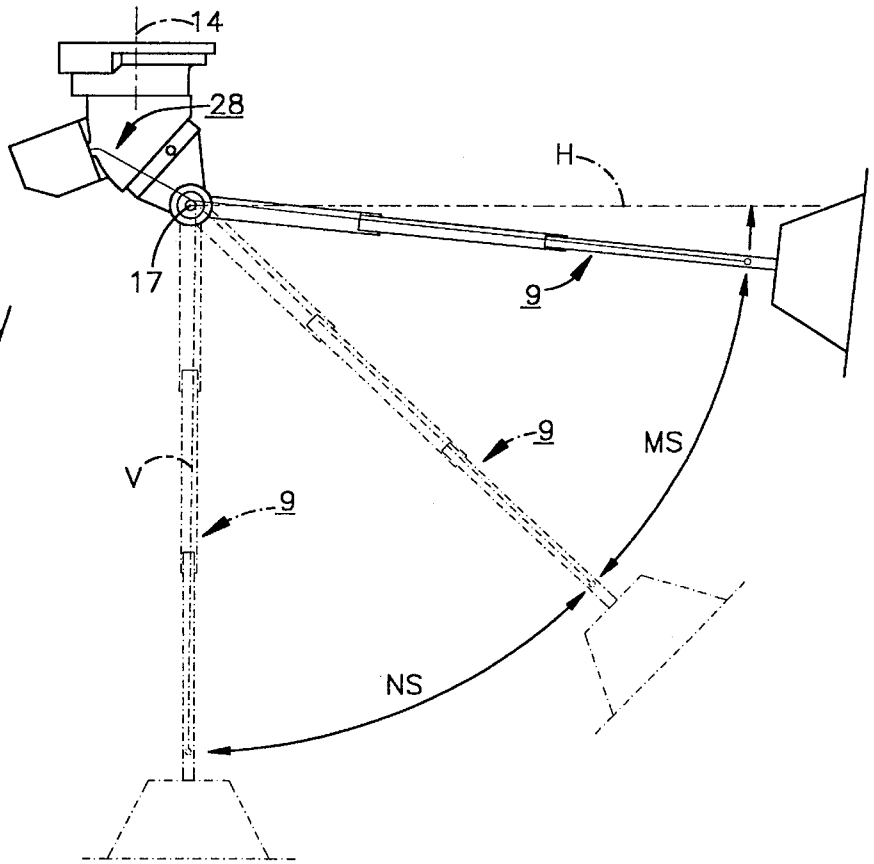
FIG. 3 illustrates the arrangement according to the invention with an associated device that generates balancing forces with respect to the telescoping function.

The extraction arrangement 1 illustrated on the drawings is intended for the extraction of harmful gases from a workplace 2, for example a welding workplace. For this purpose the extraction arrangement 1 is connected to an extraction system 3 which may exhibit an arrangement 4, for example a fan arrangement, to generate a negative pressure in the extraction arrangement 1 so that harmful gases are drawn into it via a gas intake 5, also known as a suction hood, and a hose 6, and finally away via extraction system 3. This may also exhibit a filter arrangement 7 to filter the harmful gases so that they are released into the environment in a purified state. The extraction arrangement 1 also has a carrying part 8, in order among other things to carry a carrier arm system 9 and this carrying part 8 exhibits a tubular anchoring device 10 which, via a bracket 11 is anchorable via a wall 12 or other suitable anchoring point adjacent to the workplace 2. The tubular anchoring device 10 is connected to a pipe **3*a* in the extraction system 3. Further, the carrying part 8 exhibits a bent pipe part 13 which is rotatably mounted on the tubular anchoring device 10 so that the bent pipe part 13 and with it the carrier arm system 9 can be rotated around a vertical or substantially vertical axis 14. Thus the carrier arm system 9 can be swivelled through about 180 °, namely between a position where the gas intake 5 is situated at the wall 12 or equivalent on one side of the bracket 11 and a position where the gas intake 5 is situated at the wall 12 or equivalent on the other side of the bracket 11. Between these positions, the carrier arm system 9 and with it the gas intake 5** can be positioned at any intermediate extraction position.

The bent pipe part 13 exhibits an obliquely downward-forward directed attaching fork 15. The carrier arm system 9 exhibits a fork-shaped attaching part 16 which is attached at the attaching fork 15 via a horizontal spindle 17 so that the carder arm system 9 can be swivelled in the vertical direction S between a downward-directed, preferably substantially vertical end position V and an outward-directed preferably substantially horizontal end position H.

Between the attaching fork 15 and the fork-shaped attaching part 16 there is/are preferably arranged one or two friction devices 18, which consist of friction material or which have friction surfaces. Because the horizontal spindle 17 is formed by a bolted connection, one can, for example, increase the frictional resistance in the joint by tightening the bolted connection.

The carrier arm system 9 has in addition an inner arm 19 which, via the fork-shaped attaching part 16 is attached at the attaching fork 15. The carrier arm system 19 also exhibits an intermediate arm 20 which is telescopically inserted into the inner arm 19 and an outer arm 21 which is telescopically inserted into the intermediate arm 20. The gas intake 5 is attached to the outer arm 21 via a double joint **5*a* so that it (the gas intake 5**) can be swivelled around both a horizontal and a vertical axis.

The lengths of the arms are chosen so that the intermediate arm 20 can be inserted so tier into the inner arm 19 that only a small part of the intermediate arm 20 projects from the inner arm 19 and in its turn the outer arm 21 can be inserted so far into the intermediate arm 20 that only a small part of the outer arm 21 projects from the intermediate arm 20. By telescopically compressing the arms 19, 20, 21 the extraction arrangement 1 can be given a short length and by pulling the arms 19, 20, 21 as far out as they will go the length of the extraction system can be nearly tripled.

The hose 6 is attached at the front to the back of the gas intake 5 and at the back to the bent pipe pan 13. In addition, the length of the hose 6 can be varied so that it can extend to the required degree when the carrier arm system 9 is extended and retract itself when the carrier arm system 9 is shortened.

A first device 22 is arranged to generate balancing forces in order to facilitate swivelling of the carrier arm system 9 in the vertical direction S and/or to facilitate the retention of carrier arm system 9 in set positions between the end positions V and H.

Figure 2:
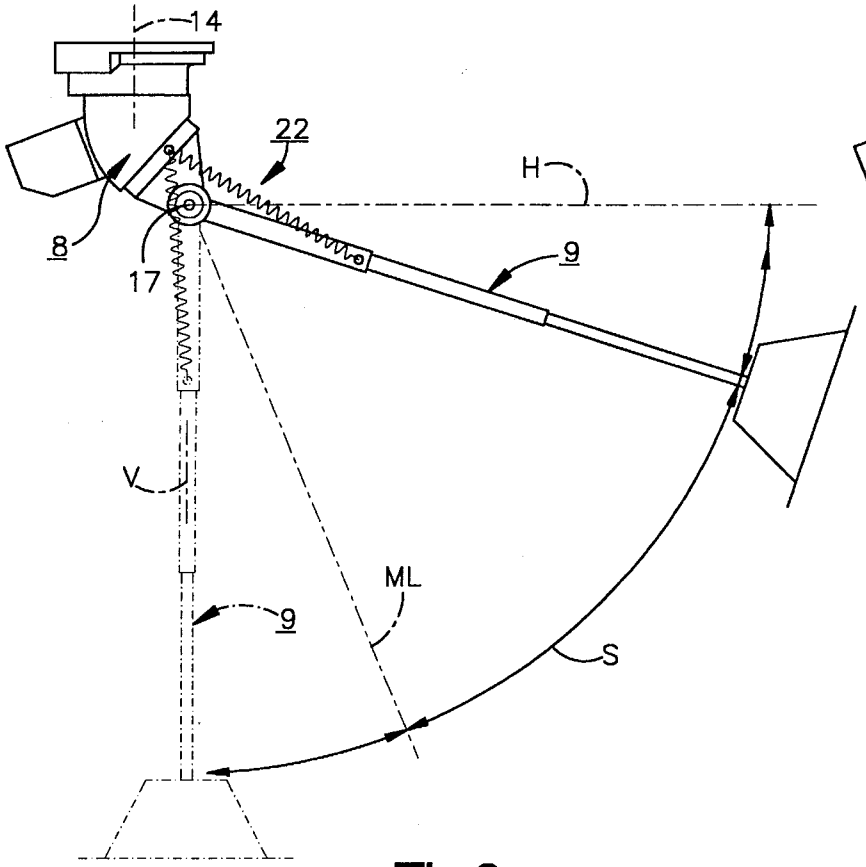
FIG. 2 illustrates the arrangement according to the invention schematically with an associated device that generates balancing forces during swivelling and positioning of the arrangement.

The first device 22 is preferably arranged to exert its greatest balancing force on the carrier arm system 9 when the carder arm system 9 takes up a midway position ML (see FIG. 2). Further, the first device 22 is preferably arranged so that, for example, it reduces its balancing force action on the carrier arm system 9 when this is swivelled further downwards from the said midway position ML. In this way the balancing effect of the device 22 can be at its most exact when it is most needed.

The first device 22 is further preferably so arranged that the carrier arm system 9 is situated in the midway position ML when the angle α between the carrier arm system 9 and the downward-directed end position V is 20°–30°.

The first device 22 is preferably a helical spring 23, one end of which is attached at a flange 24 which projects laterally from the inner arm 19. The other end of the helical spring 23 is attached at an attaching device 25 which is arranged on the bent pipe pan 13 and extends between one fork flange 26 of attaching fork 15 and a wall piece 27 of bent pipe part 13. The attaching device 25 is, viewed from the side towards the extraction arrangement 1 (see FIG. 2), on the one hand positioned on a level above the horizontal spindle 17 and on the other hand positioned behind a vertical plane through the horizontal spindle 17.

Figure 4:
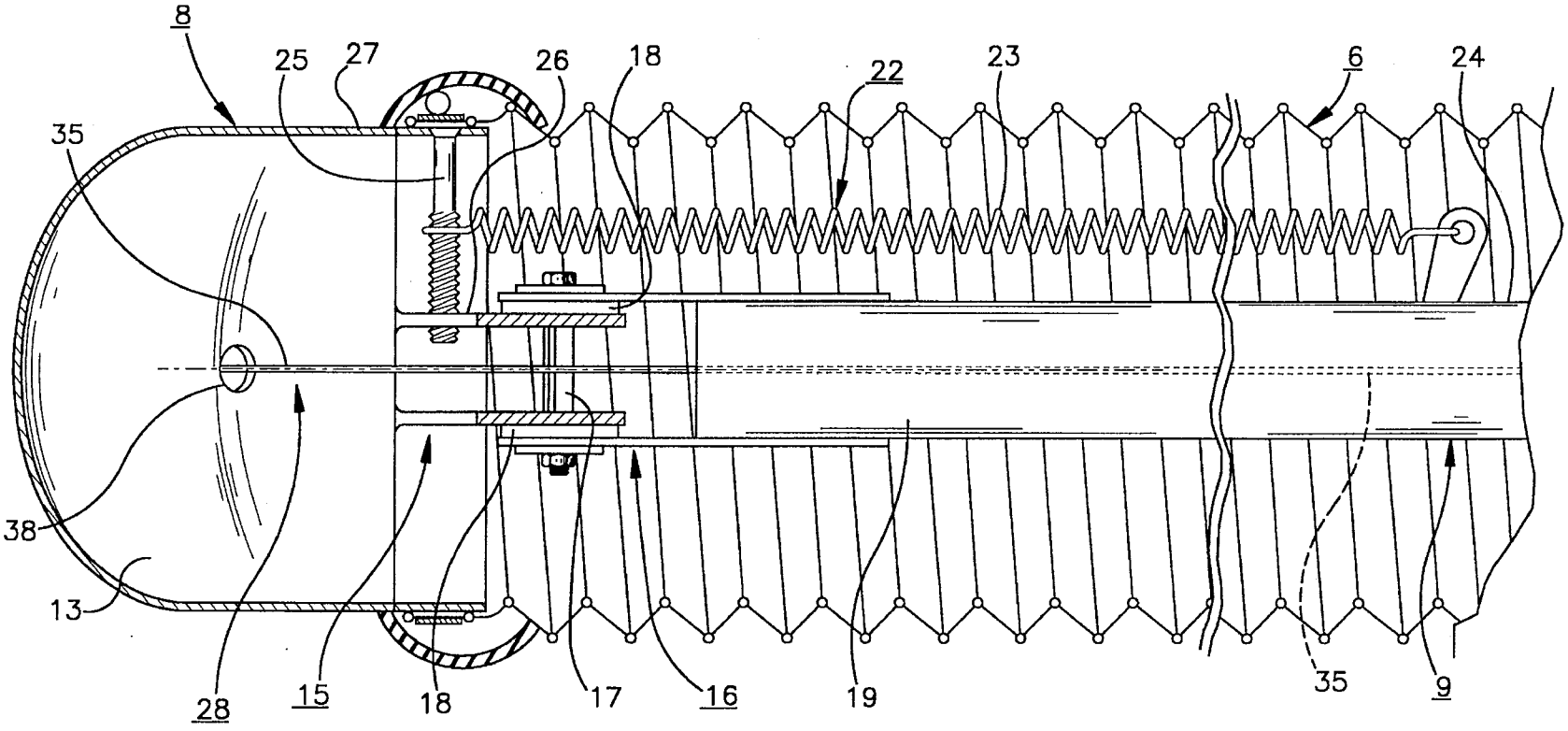
FIG. 4 illustrates a section IV—IV of the arrangement according to FIG. 1.
Figure 5:
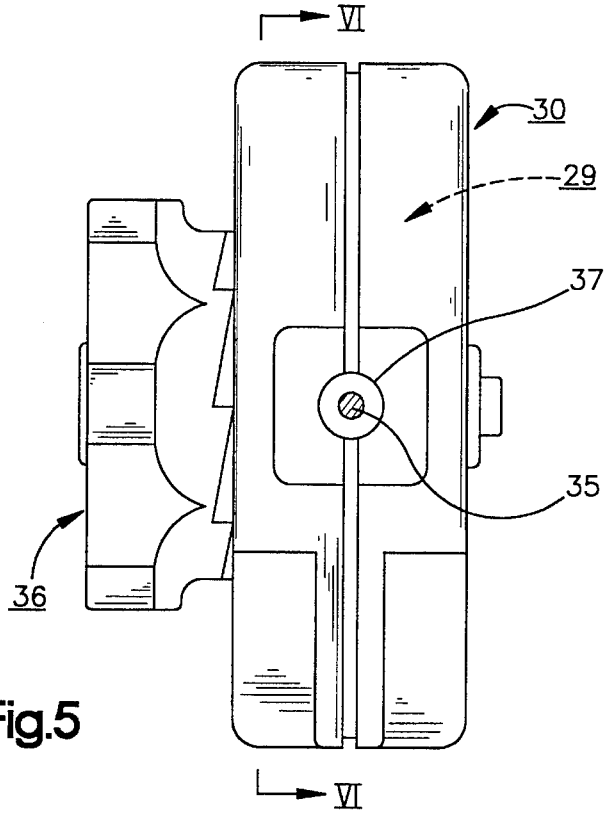
FIG. 5 illustrates a spring housing included in the invention.
Figure 6:
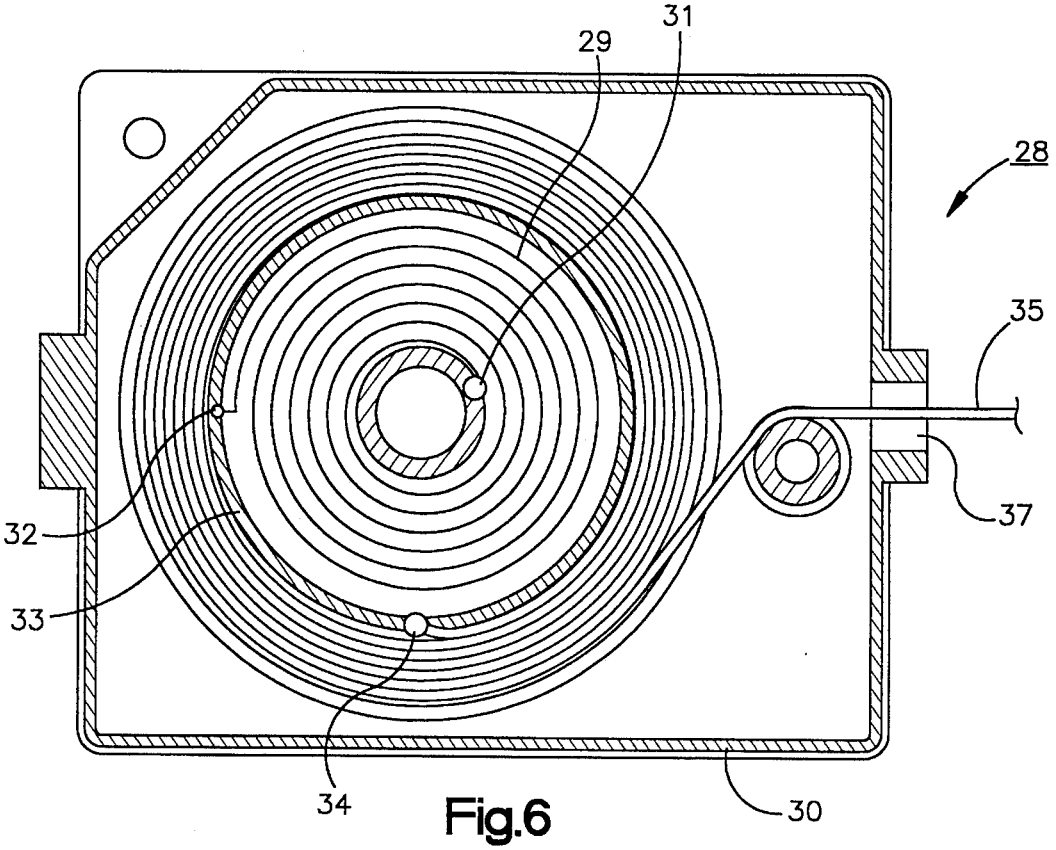
FIG. 6 illustrates a section VI—VI of the spring housing according to FIG. 5.
Figure 7:
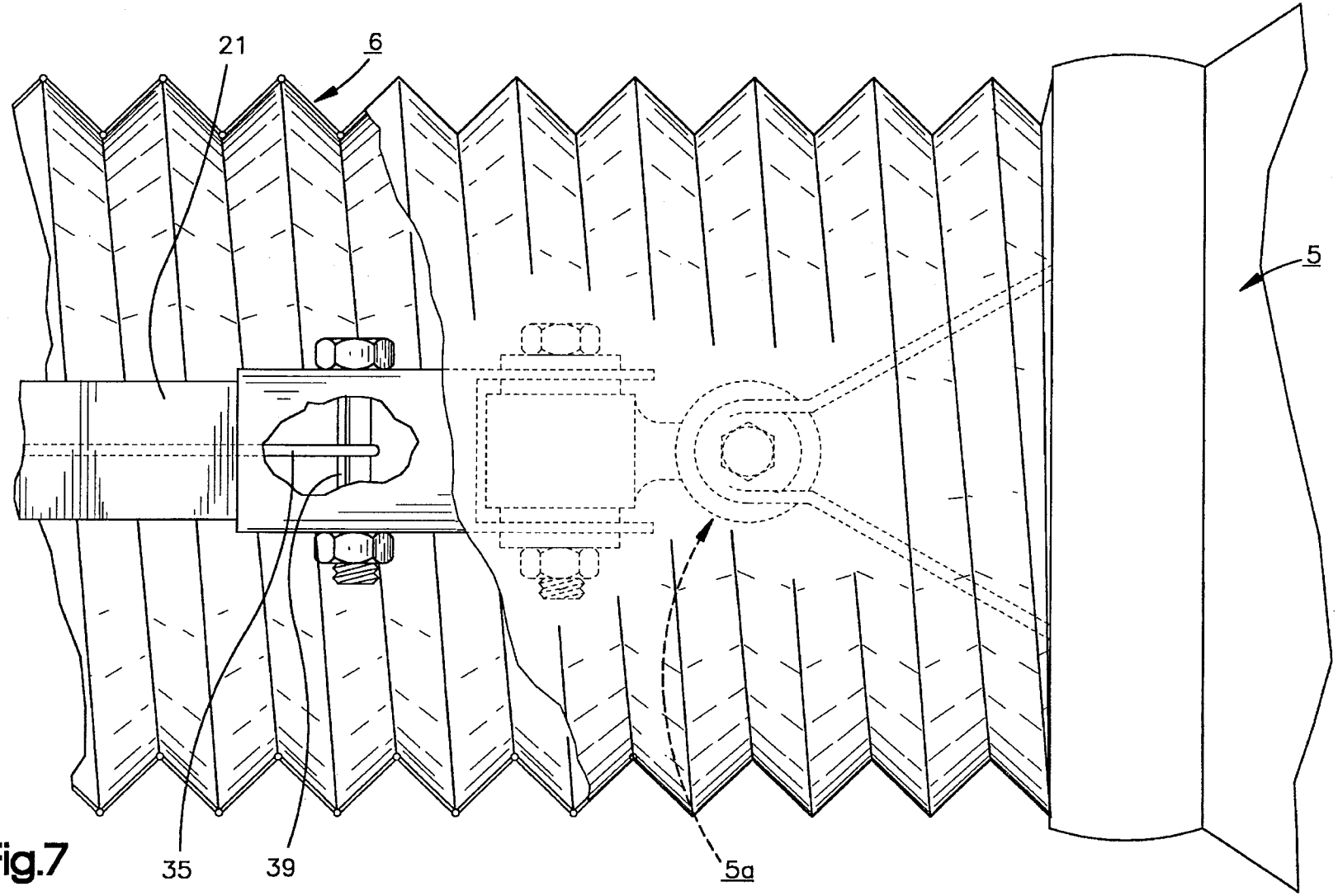
FIG. 7 illustrates a section VII—VII of the arrangement according to FIG. 1.

As FIG. 4 shows, the helical spring 23 is arranged laterally offset relative to the horizontal spindle 17, as a result of which the helical spring 23 can pass the horizontal spindle 17 when the carrier arm system is swivelled. The helical spring 23 is tensioned and exerts increased force on the carrier arm system 9 when this is swivelled down until the carrier arm system 9 reaches the said midway position ML. In this position the helical spring is in a position where—viewed from the side—it crosses the horizontal spindle 17. In this position the helical spring 23 exerts greater spring force on the carrier arm system 9 than in other positions. If, for example, the carrier arm system 9 is swivelled further downwards, the force exerted on it by the helical spring 23 thus decreases.

If the helical spring 23 at any position or positions of the carrier arm system 9 cannot balance it fully, the frictional force at the previously mentioned friction device 18 may be increased to compensate for this.

A second device 28 is arranged to generate balancing forces which allow the arms 19, 20, 21 to remain in the positions relative to each other that they were given by the telescopic function, at least when the carrier arm system 9 is directed downwards.

This second device 28 is arranged to generate such balancing forces that the arms 19, 20, 21 are kept in their set positions relative to each other while the carrier arm system 9 is being swivelled or is set within a lower sector NS closest to the lower end position V, for example within a sector NS of 40°–50° from the vertical plane V.

When the carrier arm system 9 is swivelled or is set in a sector MS above the said sector NS, principally the mutual friction between the arms 19, 20, 21 keeps the arms 19, 20, 21 in their set positions relative to each other, which means that the second device 28 need exert only partially or not at all any balancing forces on the arms when the carrier arm system 9 is situated above the said sector NS.

The second device 28 exhibits a spirally-shaped leaf spring 29, which is arranged in a spring housing 30. The inner end of the spirally-shaped leaf spring is attached to the spring housing 30 at an attaching point 31 and its outer end is attached at an attaching point 32 to a rotatable drum 33. On the drum 33 there is attached at an attaching point 34 an elongated pull device 35, preferably a wire or a cord, which can be wound on to or off from the drum 33 when this rotates.

The spring force of the spirally-shaped leaf spring 29 can be adjusted by means of a knob 36 which is rotatably mounted externally on the spring housing 30. This is arranged externally on the rear of the bent pipe part 13 and attached to this by means of a yoke or the like. The spring housing 30 exhibits a hole 37 through which the elongated pull device 35 can pass out and the bent pipe part 13 has a hole 38 through which the pull device 35 can pass in to the bent pipe part 13 and on through the inside of arms 19, 20, 21 to an attaching device 39 via which the pull device is attached to the outer arm 21. The attaching device 39 may be a bolted connection which retains the double joint **5*a* at the outer arm 21**.

When the carrier arm system 9 is extended when the arms 19, 20, 21 are pulled out relative to each other the spirally-shaped leaf spring 29 is tensioned and thus keeps the arms 19, 20, 21 in their set positions relative to each other. When the carrier arm system 9 is swivelled downwards, the spirally-shaped leaf spring 29 is tensioned and its spring force is greatest when it is most needed, namely when the carrier arm system is set in the downward directed end position V. If the carrier arm system 9 is swivelled upwards from the downward directed end position V, the spring force of spirally-shaped leaf spring 29 decreases and it smallest in the upper sector MS and especially at the upper end position H.

The arms 19, 20, 21 make contact with each other preferably via slider devices 40 which are arranged in such a way that they have a stop function to prevent the arms 19, 20, 21 from being pulled apart.

Every slider device 40 is preferably elongated and exhibits ridges 41 that form sliding surfaces 42, Every slider device 40 also has a preferably elongated fixing plug 43 to permit fixing of slider device 40 to arm 19, 20 or 21, as the case may be.

The arms 19, 20, 21 have preferably a four-sided profile and have at their outer ends preferably an elongated fixing hole 44 for a slider device 40 in each side.

Figure 8:
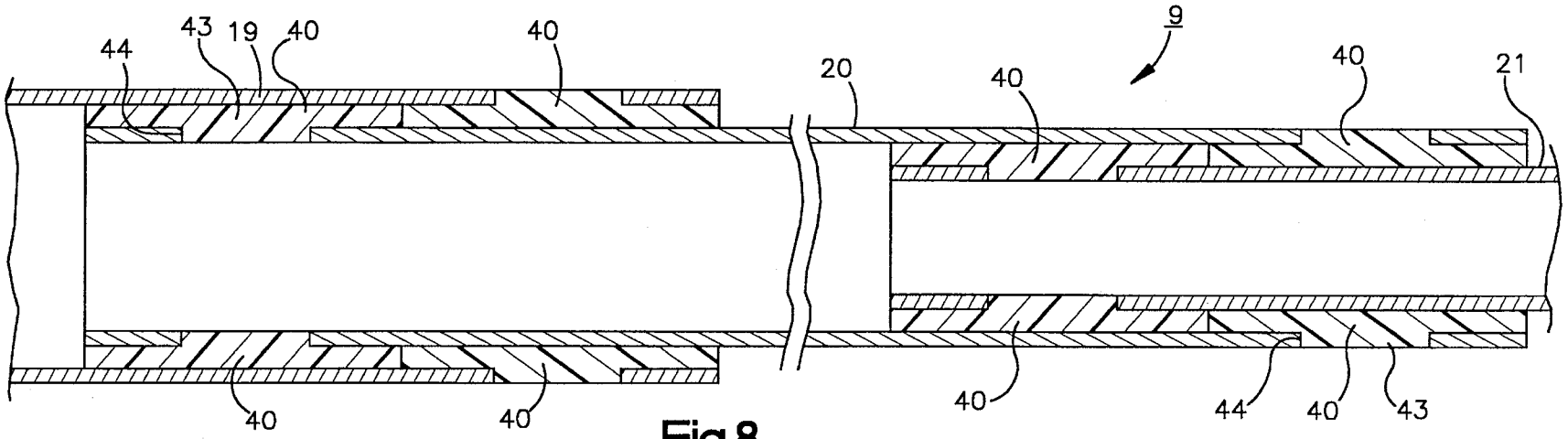
FIG. 8 illustrates arms included in the arrangement according to the invention with a section and in maximally extended positions.
Figure 9:
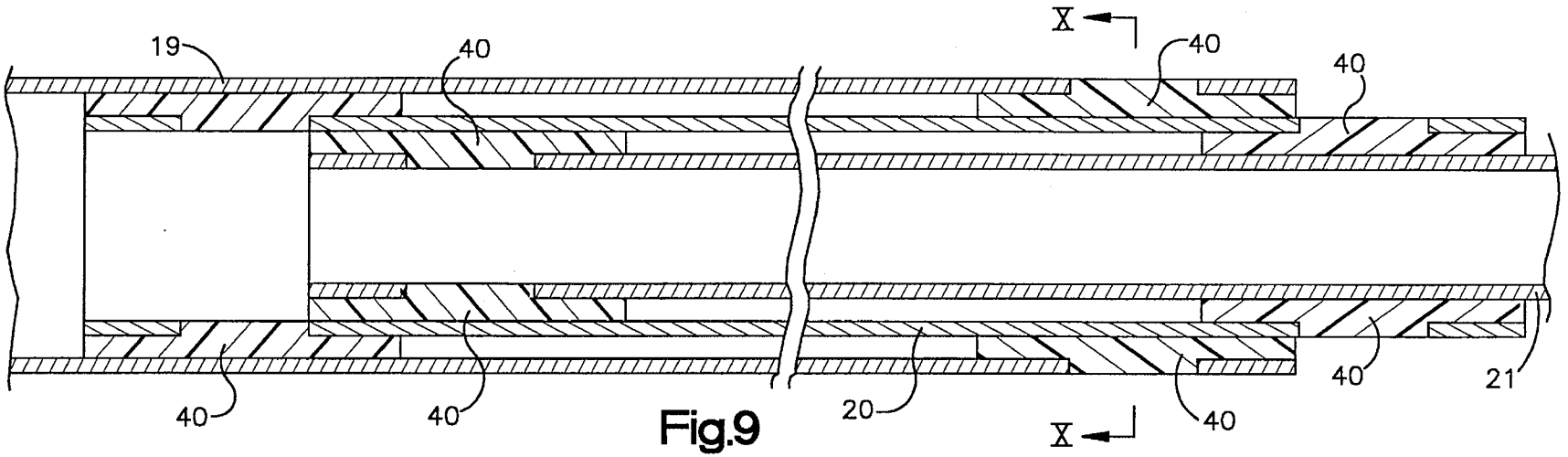
FIG. 9 illustrates the arms according to FIG. 8 with a section and in retracted positions.
Figure 10:
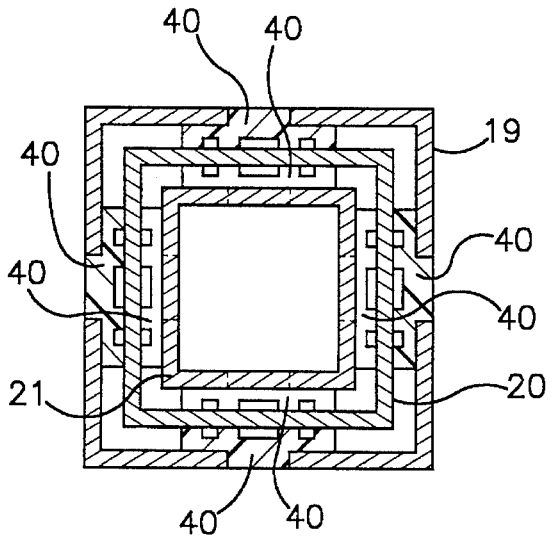
FIG. 10 illustrates a section X—X of the arms in FIG. 9.
Figure 11:
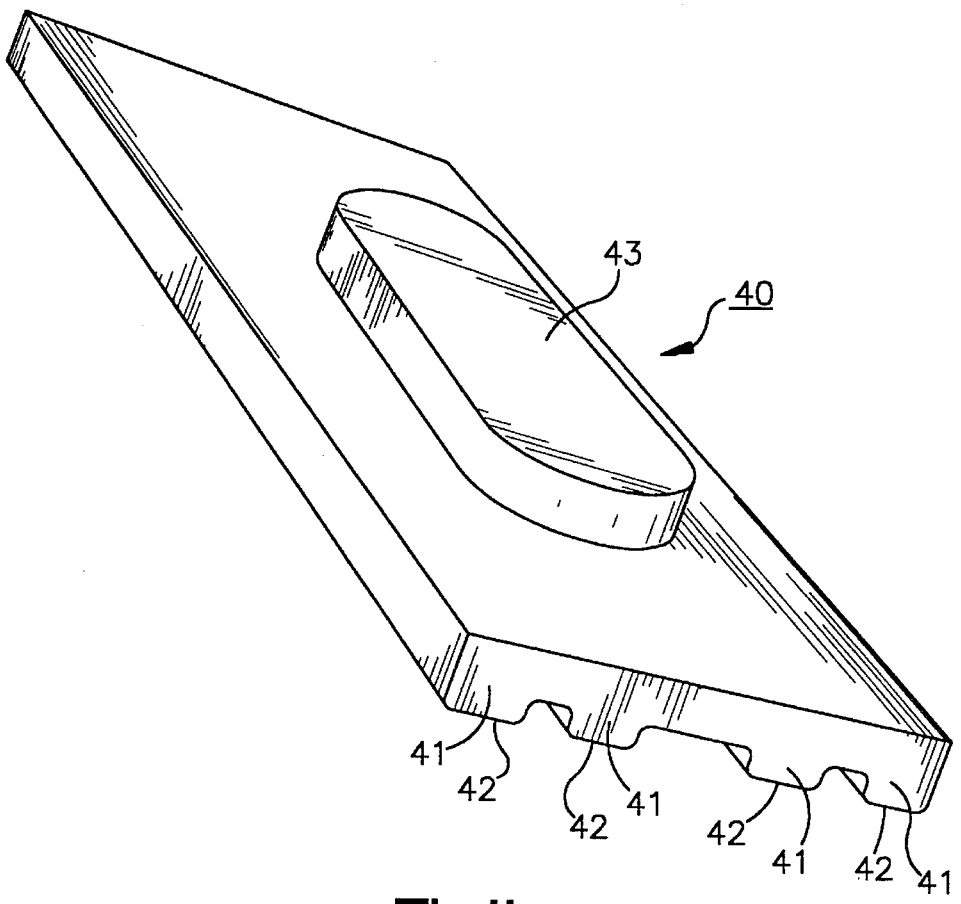
FIG. 11 illustrates with a perspective view a slider block included in the arrangement according to the invention.

Every arm 19, 20, 21 has at its outer end slider devices 40 so arranged that the outside of an internally situated arm can make contact with its slider device 40. Thus, for example, the arm 20 in FIG. 8 has inward-facing slider devices 40 with which the inside of the arm 21 can make contact. At their inner ends, the arms 20, 21 have slider devices 40 so arranged facing outwards that they, via these, can make contact with the inside of an outside arm. Thus the slider devices 40 at, for example, the inner end of the arm 21 make contact with the inside of the arm 20.

By virtue of the slider devices 40 being so arranged that an inward-facing slider device 40 on one arm is supported by an outward-facing slider device on an arm interacting with it when one arm is pulled out relative to the other arm, the inward-facing slider devices 40 will form stop devices for further extension (see FIG. 8) and thus prevent the arms from becoming separated from each other.

Further, the slider devices 40 are preferably so arranged that the longitudinal ridges 41 and thus the sliding surfaces 42 and the fixing plugs 43 extend in the longitudinal direction of the arms 19, 20, 21.

The object of the invention is not limited to the embodiment described above and illustrated on the drawings but may vary within the framework of the claims below. Thus the hose 6 may enclose the carder arm system 9 as shown, but may alternatively be suspended on the carrier arm system in another way. The first device 22 that generates balancing forces may be a force-generating device other than a helical spring and there may be more than one such device. The second device 28 that generates balancing forces may be a force-generating device other than a spirally-shaped leaf spring with an elongated pull device and there may be more than one such device. The carrier arm system 9 may exhibit two, three or more arms 19, 20, 21 and the profile of these may be other than four-sided. The downward-directed end position V need not be a vertical end position but may be another suitable downward-directed end position and the outward-directed position H need not be a horizontal end position but may be another suitable outward-directed end position. Finally, spring housing 30 may be arranged inside the carrying part 8 or inside other parts of the extraction arrangement and the spring force of its spirally-shaped leaf spring 29 may be adjustable with a spring force adjustment device other than a knob 36. All slider devices 40 may be of the same shape but they may alternatively exhibit different shapes.

I claim:

1. An arrangement for the extraction of harmful gases from workplaces comprising:

(a) a carrying arm assembly comprising a first arm and a second arm, said arms being slidably connected so that said carrier arm assembly is longitudinally extendable;

(b) a flexible and extendable gas hose carried by and extendable with said carrier arm assembly, said gas hose having a gas intake;

(c) a horizontal spindle supporting one end of said first arm for pivot movement of the carrier arm assembly on said spindle in an arc VH between a substantially horizontal position H and a substantially vertical position V, said spindle having a front side defined by said arc VH and a rear side opposite said front side;

(d) a first tension device comprising a tension spring connected at one end to said first arm at a point remote from said spindle and at the opposite end at a point above said spindle and on the rear side of said spindle, said first tension device resisting said pivot movement of said carrier arm assembly in said arc VH, said tension spring being movable in a plane which is offset from said spindle for unhindered movement of the tension spring in said plane throughout the pivot movement of the carrier arm assembly in said arc VH; and (e) a second tension device comprising (i) a biasing spring means connected to the second of said arms biasing said carrier arm assembly against extension of said assembly, and (ii) adjustment means to adjust the force of said biasing spring means;

said first and second tension devices permitting setting said gas intake at extended and non-extended vertical and horizontal locations in a sector defined by said spindle and the positions H and V and then retention at said locations.

2. The arrangement of claim 1 wherein said biasing spring means is a spirally-wound spring and said adjustment means is a means for adjusting the tension exerted by the spirally-wound spring.

3. The arrangement of claim 2 wherein said second tension device further comprises a housing for said spirally-wound spring and a spring force setting means mounted on said housing for adjusting the tension setting of the spirally-wound spring.

4. The arrangement of claim 3 comprising a support connected to and supporting said carrier arm assembly, said support comprising swivel means permitting swivel movement of said carrier arm assembly around an essentially vertical axis, said spirally-wound spring housing being mounted on said support.

5. The arrangement of claim 4 wherein said support is a pipe elbow and said gas hose is connected in fluid communication with said pipe elbow, said second tension device comprising a line connected to said spirally-wound spring and passing through said pipe elbow.

6. The arrangement of claim 5 wherein said first and second arms are connected together telescopically and said line extends over said horizontal spindle and through said arms.

7. The arrangement of claim 1 comprising a first friction means between said horizontal spindle and said first arm of said carrier arm assembly resisting the pivotal movement of said carrier arm assembly, and means for varying the friction of said first friction means.

8. The arrangement of claim 7 wherein said first friction means comprises a friction plate on said horizontal spindle, said plate being engaged by said first arm of said carrier arm assembly.

9. The arrangement of claim 1 wherein said carrying arm assembly comprises three arms, one of said arms being intermediate the first and second arms.

10. The arrangement of claim 1 including means supporting said horizontal spindle, said means permitting swivel movement of said spindle about an essentially vertical axis.

11. An arrangement for the extraction of harmful gases from workplaces comprising:

(a) a carrying arm assembly comprising a first tubular arm and a second tubular arm, said arms being telescopically slidably connected so that said carrier arm assembly is longitudinally extendable, one of said arms being an outer arm and one of said arms being an inner arm;

(b) a flexible and extendable gas hose carried by and extendable with said carrier arm assembly, said gas hose having a gas intake;

(c) a horizontal spindle supporting one end of said first arm for vertical pivot movement of the carrier arm assembly on said spindle in an arc VH between a substantially horizontal position H and a substantially vertical position V, said spindle having a front side defined by said arc VH and a rear side opposite said front side;

(d) a first tension device comprising a tension spring connected at one end to said first arm at a point remote from said spindle and at the opposite end at a point above said spindle and on the rear side of said spindle, said first tension device resisting said pivot movement of said carrier arm assembly in said arc VH, said tension spring being movable in a plane which is offset from said spindle for unhindered movement of the tension spring in said plane throughout the pivot movement of the carrier arm assembly in said arc VH;

(e) a second tension device comprising (i) a biasing spring means connected to the second of said arms biasing said carrier arm assembly against extension of said assembly, and (ii) adjustment means to adjust the force of said biasing spring means;

(f) a stop means to prevent said arms from becoming disconnected when the carrying arm assembly is extended; and (g) friction means establishing a friction force between said first and second arms;

said first and second tension devices and said friction means permitting setting said gas intake at extended and non-extended vertical and horizontal locations in a sector defined by said spindle and the positions H and V and then retention at said locations.

12. The arrangement of claim 11 wherein said stop means comprises:

(i) an inwardly projecting slider on the outer of said arms engaging the outer surface of the inner arm;

(ii) an outwardly projecting slider on the inner of said arms engaging the inner surface of the outer arm.

13. An arrangement for the extraction of harmful gases from workplaces comprising:

(a) a carrying arm assembly comprising a first tubular arm and a second tubular arm, said arms being telescopically slidably connected so that said carrier arm assembly is longitudinally extendable, one of said arms being an outer arm and one of said arms being an inner arm;

(b) a flexible and extendable gas hose carried by and extendable with said carrier arm assembly, said gas hose having a gas intake;

(c) a horizontal spindle supporting one end of said first arm for vertical pivot movement of the carrier arm assembly on said spindle in an arc VH between a substantially horizontal position H and a substantially vertical position V, said spindle having a front side defined by said arc VH and a rear side opposite said front side;

(d) a first tension device comprising a tension spring connected at one end to said first arm at a point remote from said spindle and at the opposite end at a point above said spindle and on the rear side of said spindle, said first tension device resisting said pivot movement of said carrier arm assembly in said arc VH, said tension spring being movable in a plane which is offset from said spindle for unhindered movement of the tension spring in said plane throughout the pivot movement of the carrier arm assembly in said arc VH;

(e) a second tension device comprising (i) a biasing spring means connected to the second of said arms biasing said carrier arm assembly against extension of said assembly, and (ii) adjustment means to adjust the force of said biasing spring means; and (f) a stop means to prevent said arms from becoming disconnected when the carrying arm assembly is extended, said stop means comprising:

(i) an inwardly projecting slider on the outer of said arms engaging the outer surface of the inner arm;

(ii) an outwardly projecting slider on the inner of said arms engaging the inner surface of the outer arm;

each of said sliders comprising a main body part which is positioned between the inner and outer arms, and an attaching plug on said main body part attaching the slider to its respective arm, said main body part being oblong and providing frictional resistance to movement of one arm with respect to the other;

said first and second tension devices and said sliders permitting setting said gas intake at extended and non-extended vertical and horizontal locations in a sector defined by said spindle and the positions V and H and then retention at said locations.

14. The arrangement of claim 13 wherein said main body part is ridged on the sliding surface thereof in a longitudinal direction with respect to the arm.

15. The arrangement of claim 14 wherein said arms are rectangular in cross-section and each arm has a slider on each side of the arm.

* * * * *